US012575687B2

(12) United States Patent
Olufeso

(10) Patent No.: US 12,575,687 B2
(45) Date of Patent: Mar. 17, 2026

(54) AUTOMATED BED OR BABY COT

(71) Applicant: Insight and InReach (ISnIR) Pty Ltd, Victoria (AU)

(72) Inventor: Christopher Olufeso, Victoria (AU)

(73) Assignee: Insight and InReach (ISnIR) Pty Ltd, Victoria (AU)

( * ) Notice: Subject to any disclaimer, the term of this patent is extended or adjusted under 35 U.S.C. 154(b) by 468 days.

(21) Appl. No.: 17/312,754

(22) PCT Filed: Dec. 13, 2019

(86) PCT No.: PCT/GB2019/053553

§ 371 (c)(1),
(2) Date: Jun. 10, 2021

(87) PCT Pub. No.: WO2020/120993

PCT Pub. Date: Jun. 18, 2020

(65) Prior Publication Data

US 2022/0053947 A1 Feb. 24, 2022

(30) Foreign Application Priority Data

Dec. 13, 2018 (GB) ..... 1820367

(51) Int. Cl.
*A47D 7/03* (2006.01)
*A47D 9/00* (2006.01)

(52) U.S. Cl.
CPC ..... *A47D 7/03* (2013.01); *A47D 9/012* (2022.08)

(58) Field of Classification Search
CPC ... A47D 7/03; A47D 9/00; A47D 9/02; A61G 11/001; A61G 11/002; A61G 7/012; A61G 7/03; A47C 19/045; A47C 21/046; A47C 20/04
See application file for complete search history.

(56) References Cited

U.S. PATENT DOCUMENTS

| | | | | |
|---|---|---|---|---|
| 3,590,403 | A * | 7/1971 | Mixon | A47D 7/00 5/100 |
| 10,905,249 | B1 * | 2/2021 | Saghiri | A47C 20/041 |
| 11,052,221 | B2 * | 7/2021 | Karp | A61M 21/02 |
| 2009/0070929 | A1 | 3/2009 | Holman | |
| 2013/0247300 | A1 * | 9/2013 | Menke | G01G 23/14 5/611 |
| 2014/0059781 | A1 * | 3/2014 | Lafleche | A47C 27/083 5/713 |

(Continued)

FOREIGN PATENT DOCUMENTS

| | | | | |
|---|---|---|---|---|
| CN | 201861231 U | * | 6/2011 | A47D 5/00 |
| CN | 106667136 A | * | 5/2017 | |

(Continued)

OTHER PUBLICATIONS

CN 201861231 U—Eng Translation (Year: 2011).*

(Continued)

*Primary Examiner* — Justin C Mikowski
*Assistant Examiner* — Amanda L Bailey
(74) *Attorney, Agent, or Firm* — Kilpatrick Townsend & Stockton LLP

(57) ABSTRACT

A bed, particularly a baby cot, with features for adaptation to variations in temperature and humidity.

16 Claims, 7 Drawing Sheets

(56) References Cited

U.S. PATENT DOCUMENTS

| | | | | |
|---|---|---|---|---|
| 2014/0300476 | A1* | 10/2014 | Sabota | G08B 3/10 340/573.1 |
| 2016/0140307 | A1* | 5/2016 | Brosnan | G06Q 10/10 600/509 |
| 2018/0000352 | A1* | 1/2018 | Starr | H05B 3/0014 |
| 2018/0369035 | A1* | 12/2018 | Bhimavarapu | A61G 7/018 |
| 2019/0099009 | A1* | 4/2019 | Connor | A61B 5/398 |
| 2020/0405998 | A1* | 12/2020 | Franceschetti | A61B 5/6892 |

FOREIGN PATENT DOCUMENTS

| | | | | |
|---|---|---|---|---|
| CN | 207979391 | U | 10/2018 | |
| EP | 2292124 | A1 | 3/2011 | |
| GB | 0511318 | | 7/2005 | |
| GB | 2429400 | A | 2/2007 | |
| GB | 2464333 | A * | 4/2010 | A47D 5/006 |
| JP | 2009-131469 | A | 6/2009 | |
| JP | 2018-061553 | A | 4/2018 | |
| KR | 101268793 | B1 * | 5/2013 | A47C 20/08 |
| WO | WO-2009144338 | A1 * | 12/2009 | A47D 5/00 |
| WO | WO-2014095552 | A1 * | 6/2014 | A47C 27/064 |
| WO | WO-2016169538 | A1 * | 10/2016 | A47D 9/02 |
| WO | WO-2018216387 | A1 * | 11/2018 | A47C 20/08 |

OTHER PUBLICATIONS

WO-2018216387-A1—Eng Translation (Year: 2018).*
GB-2464333-A Eng Translation (Year: 2010).*
WO-2016169538-A1 Eng Translation (Year: 2016).*
CN-106667136-A Eng Translation (Year: 2017).*
WO 2016169538—Eng Translation (Year: 2016).*
International Patent Application No. PCT/GB2019/053553, International Search Report and Written Opinion, dated Jan. 20, 2020.
China Patent Application No. 201980080926.7, Notice of Allowance, dated Jun. 28, 2023.
Japan Patent Application No. 2021-0533344, Office Action, dated Oct. 17, 2023.

* cited by examiner

AUTOMATED BED OR BABY COT

CROSS-REFERENCE TO RELATED APPLICATIONS

This application is a national stage application of International Patent Application PCT/GB2019/053553, filed on Dec. 13, 2019 and titled "Automated Bed Or Baby Cot," which is related to and claims priority benefits from United Kingdom Patent Application No. 1820367.9, filed on Dec. 13, 2018 and titled "Automated Baby Cot," both of which are hereby incorporated by reference in their entireties.

FIELD OF THE INVENTION

The relation relates to a bed comprising temperature and humidity control features, including but not limited to cots for infants to sleep in.

BACKGROUND OF THE INVENTION

All human beings require sleep. Comfortable sleep is easiest to accomplish in comfortable environmental conditions. If it is too warm, too cold, or too humid, sleep is disturbed.

Numerous means exist for adults to control temperature or humidity during sleep. Humidifiers or dehumidifiers are known, as are temperature control methods ranging from a simple blanket to more complex electric blankets or central heating. Various means exist to allow adults (and, for that matter, sufficiently instructed children) to control these methods.

However, infants cannot be expected to understand how to adjust a thermostat or calibrate a humidifier in order to regulate the temperature of their sleeping area. Nor is it safe to provide heating means in a baby's cot—whilst an adult or responsible child can be trusted not to (for example) chew on an electric blanket or touch an electric heater, an infant cannot be expected to understand the dangers involved.

This issue is exacerbated by the fact that infants are typically more sensitive to small changes in environmental temperature or humidity than adults, and what may be within a perfectly tolerable range to an infant's carers may be very uncomfortable to the infant themselves. Responsible carers will ensure that an infant's room is not extremely cold or extremely warm, but the infant may still sense and be discomforted by small variations in temperature or humidity and call out to their carers—who must then distinguish whether the infant's cries are due to discomfort, hunger, thirst, or simply a call for attention.

Likewise, there may be situations where an adult or older child may benefit from a bed which can adjust to external temperature and humidity appropriately. Sick, disabled, injured, elderly, or invalid individuals may find it substantially more difficult to take appropriate steps by themselves.

Furthermore, it is obviously preferable for a bed to be able to adjust to external temperature and humidity without the user waking up themselves to make such adjustments, since uninterrupted sleep will be more restful than interrupted sleep.

SUMMARY OF THE INVENTION

It is noted that the temperature and humidity in an indoor room is not uniform. Hot air rises and cool air falls, and therefore within a room a gradient of temperature and humidity exists from the floor upwards.

The invention therefore presents a bed comprising a sleeping surface, an elevation mechanism arranged to set the elevation of the sleeping surface, and at least one temperature sensor and/or at least one humidity sensors, wherein the elevation mechanism alters the height of the sleeping surface based on signals from the sensor(s).

The sensors are configured to detect temperature (in the case of temperature sensors) and humidity (in the case of humidity sensors) in the environment surrounding the bed—for example, in a room which the bed is placed in, or in the immediate area surrounding the bed where the bed has been placed outside. Preferably, these sensors are configured to take their measurements at the level of the sleeping surface.

The bed may be intended for any type of person to sleep on it. The bed may preferably be a baby cot.

Advantageously, the invention does not require the inclusion of any mechanical or electrical features inside the cot or bed, ensuring the safety of the individual sleeping therein.

Advantageously, the invention allows for slight adjustment of temperature without directly incorporating a means of generating heat, further enhancing the safety of the sleeper.

Advantageously, the invention allows for slight adjustment of temperature and humidity solely by mechanically raising or lowering the cot or bed, consequently requiring less energy than a dedicated heater or humidifier.

In typical cots and beds the sleeping surface is flat, and this may be the case in the present invention. Alternately, in a preferable feature, the sleeping surface may be inclined. This may advantageously encourage circulation of the blood in a sleeping infant or individual.

Typical cots comprise an encircling wall or walls to prevent infants exiting the cot without their carer's aid. Where such an encircling wall is present they will describe an opening through which the infant is placed into or removed from the cot. Preferably, cots according to the present invention may comprise an encircling wall or walls whose elevation is also controlled by the elevation mechanism. (Whilst the sleeping surface could be raised or lowered independently of the encircling walls, this would require the encircling walls to be taller, and make it possible for a curious infant's fingers to be painfully pinched should the mechanism operate whilst they are investigating the interface between the sleeping surface and the encircling walls,)

Advantageously, cots according to the present invention may additionally comprise a cover which may be placed over the opening. This could, for instance, be a permeable cover to further control humidity, or a shade to shield the infant from bright light.

Advantageously, cots or beds according to the present invention may additionally comprise a weight sensor arranged to detect when a user is putting their weight on the sleeping surface or an infant is placed on the sleeping surface. Where this is present, the cot or bed may advantageously be configured such that the elevation mechanism only activates if the weight sensor detects an infant on the sleeping surface or a user putting their weight on the sleeping surface. This enhances the safety of the cot by ensuring that the mechanism does not operate when the infant or user is outside of the cot, thus making it impossible for the infant or user to be injured by the operating mechanism.

It is envisaged that beds according to the present invention will have uses in many contexts, including but not limited to childcare/daycare, the hotel industry, and medical care.

Potential medical benefits of beds according to the present invention arise from the manner in which the invention helps control the temperature and/or humidity experienced by the individual sleeping in the bed, which may be important in any medical situation where careful control of environmental factors experienced by a patient is a factor.

DETAILED DESCRIPTION

Figure 1:
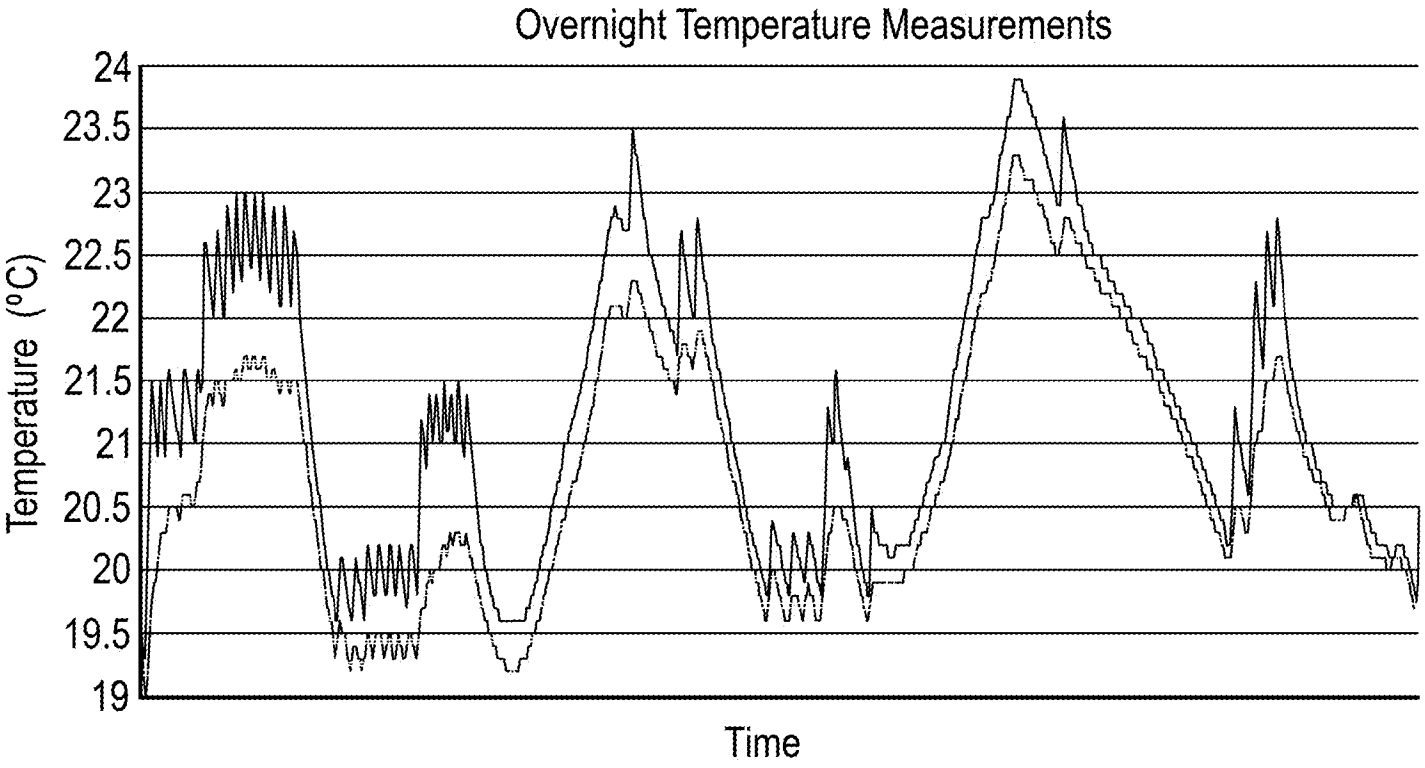
FIG. 1 is a plot of measurements of temperature at different elevations in a room over a period of time.

FIG. 1 depicts measurements of temperature conducted in a typical bedroom over a period of time ranging from 12:43 pm on the 25 Sep. 2018 (at the far left of the chart) to 16:39 pm on the 28 Sep. 2018 (at the far right). Temperature was measured with two sensors. The lower sensor, the readings from which are represented in the chart by a dashed line, was set at the typical height of most baby cots. The upper sensor, the readings from which are represented in the chart by a solid line, was set at an elevated height typical of that which may be accomplished with the present invention. It is clear from these readings that in a typical bedroom the temperature varies with altitude from the floor, both in terms of the temperature achieved (at points the temperature difference between the sensor readings is as large as 1.5° C.) and in terms of the consistency of the temperature (the higher sensor detects more to relatively rapid temperature fluctuations over time than the lower sensor).

Figure 2:
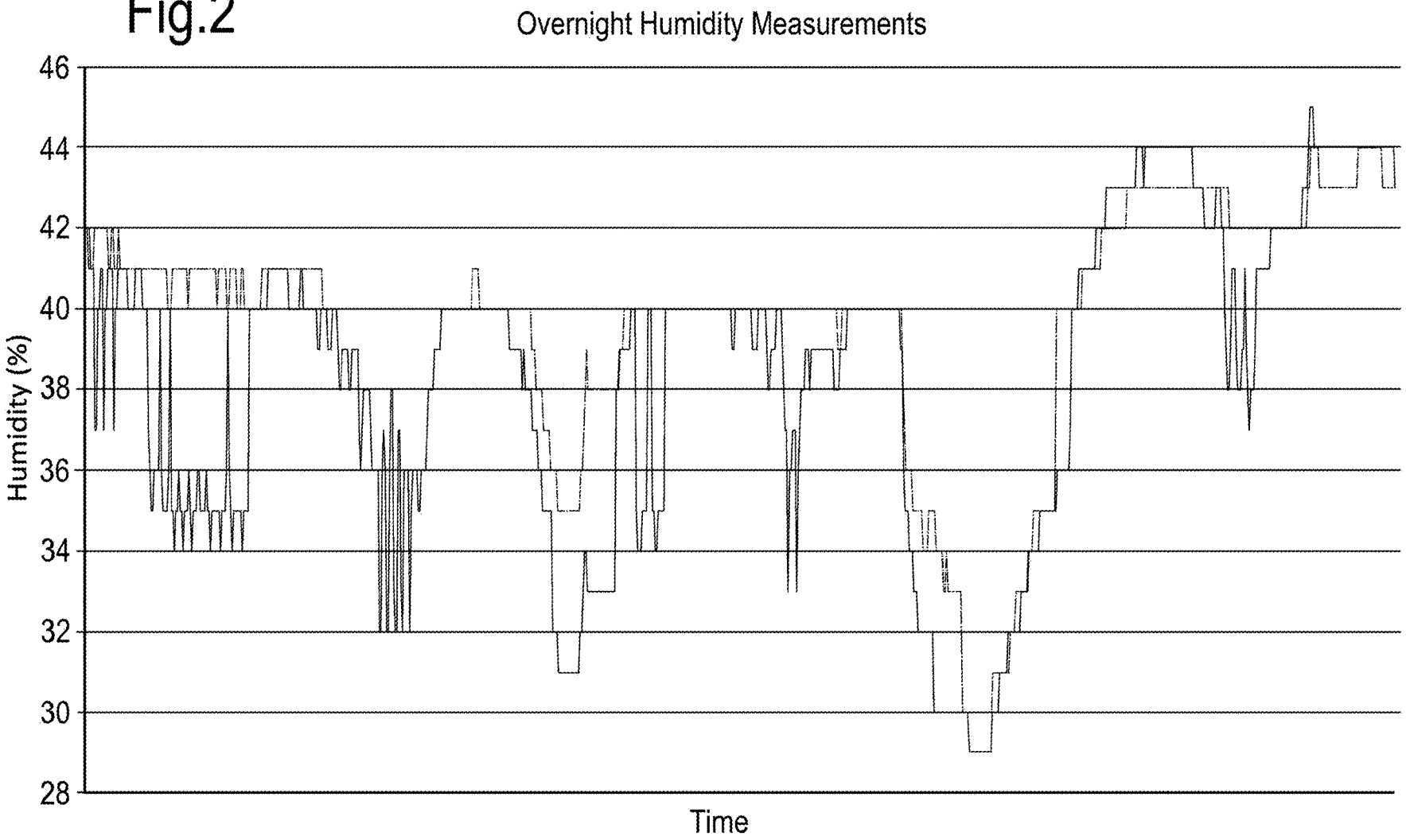
FIG. 2 is a plot of measurements of humidity at different elevations in a room over a period of time.
Figure 3:
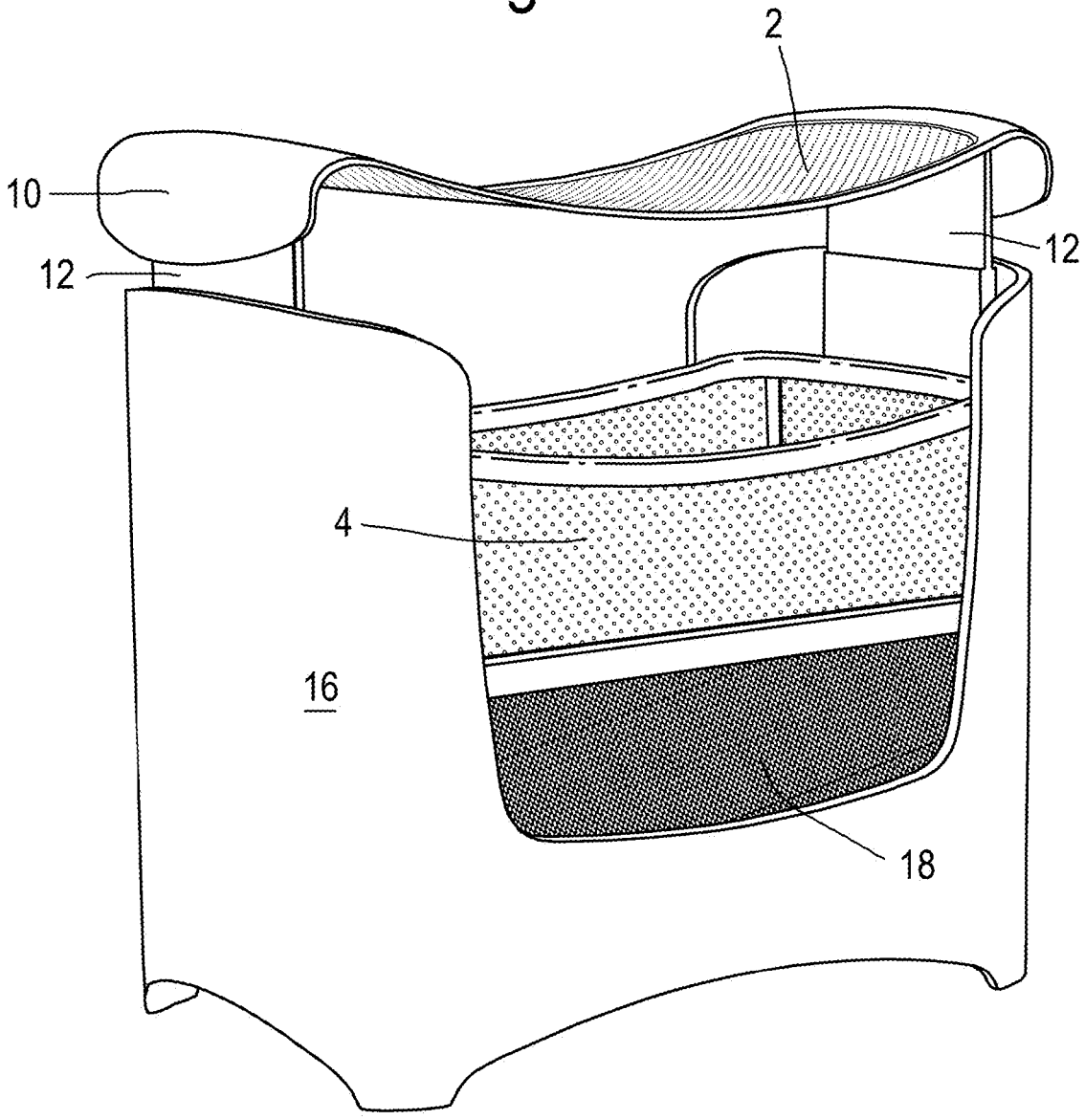
FIGS. 3-7 depict a baby cot according to the present invention, exemplifying a range of preferable features.
Figure 4:
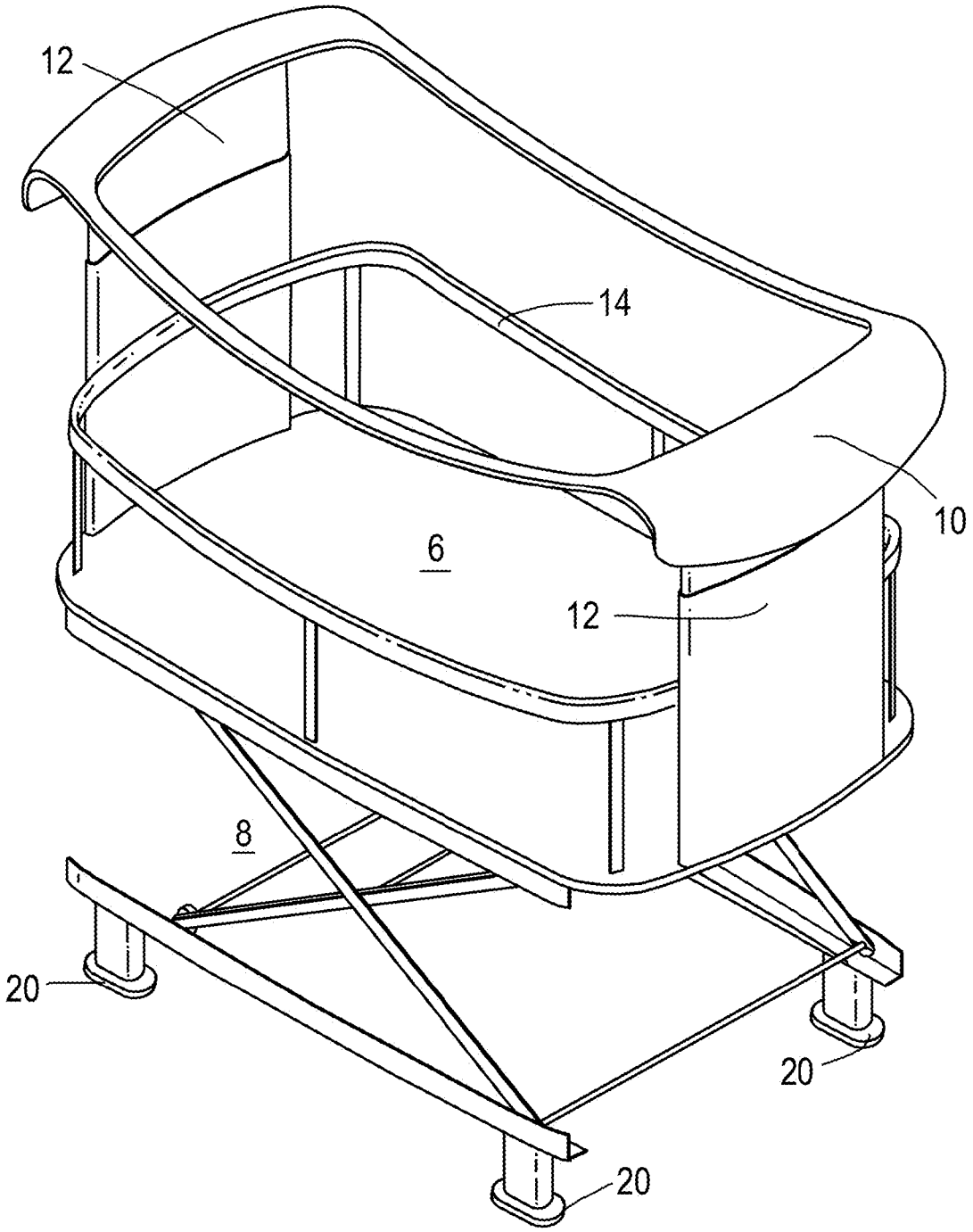
Figure 5:
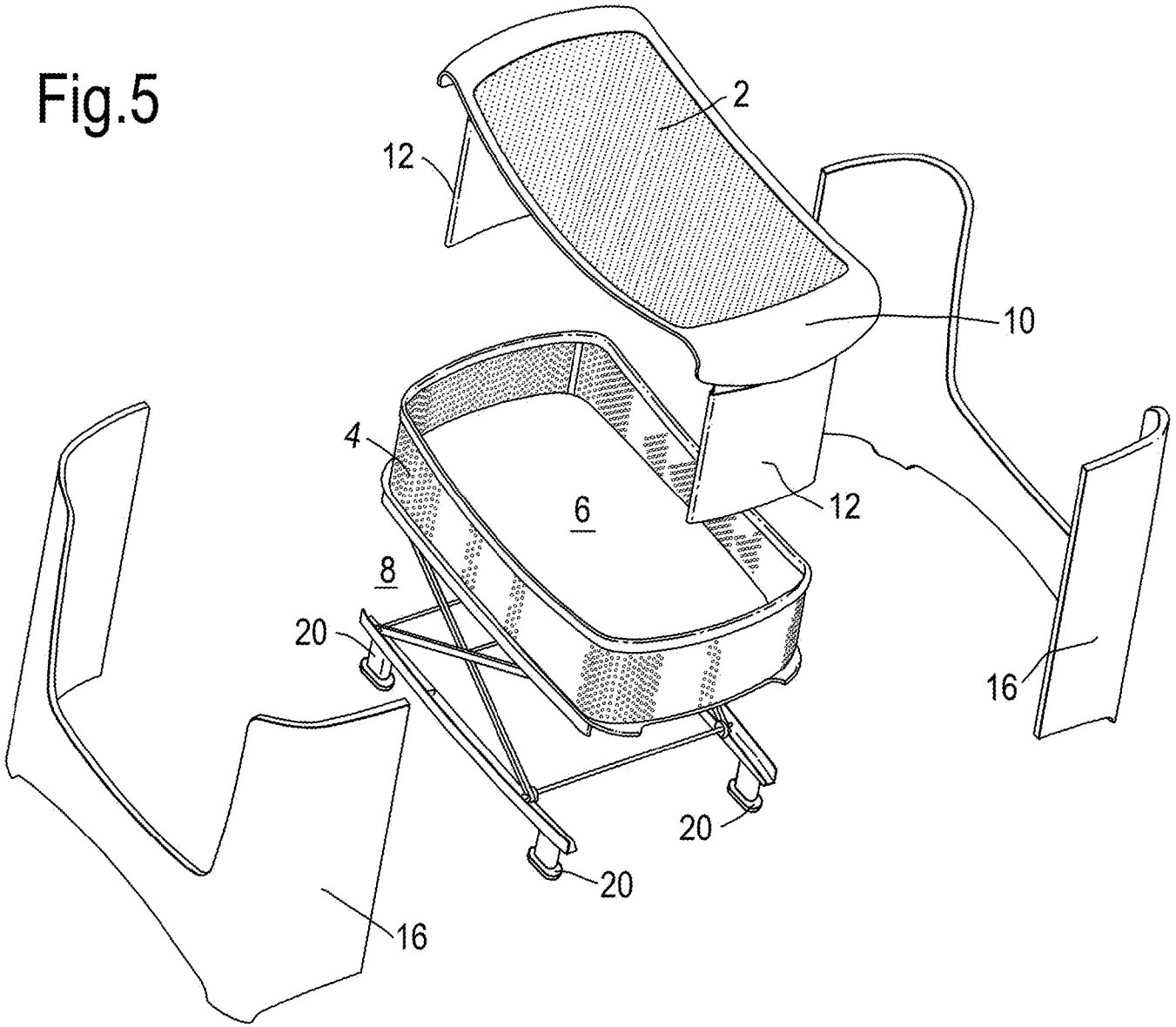
Figure 6:
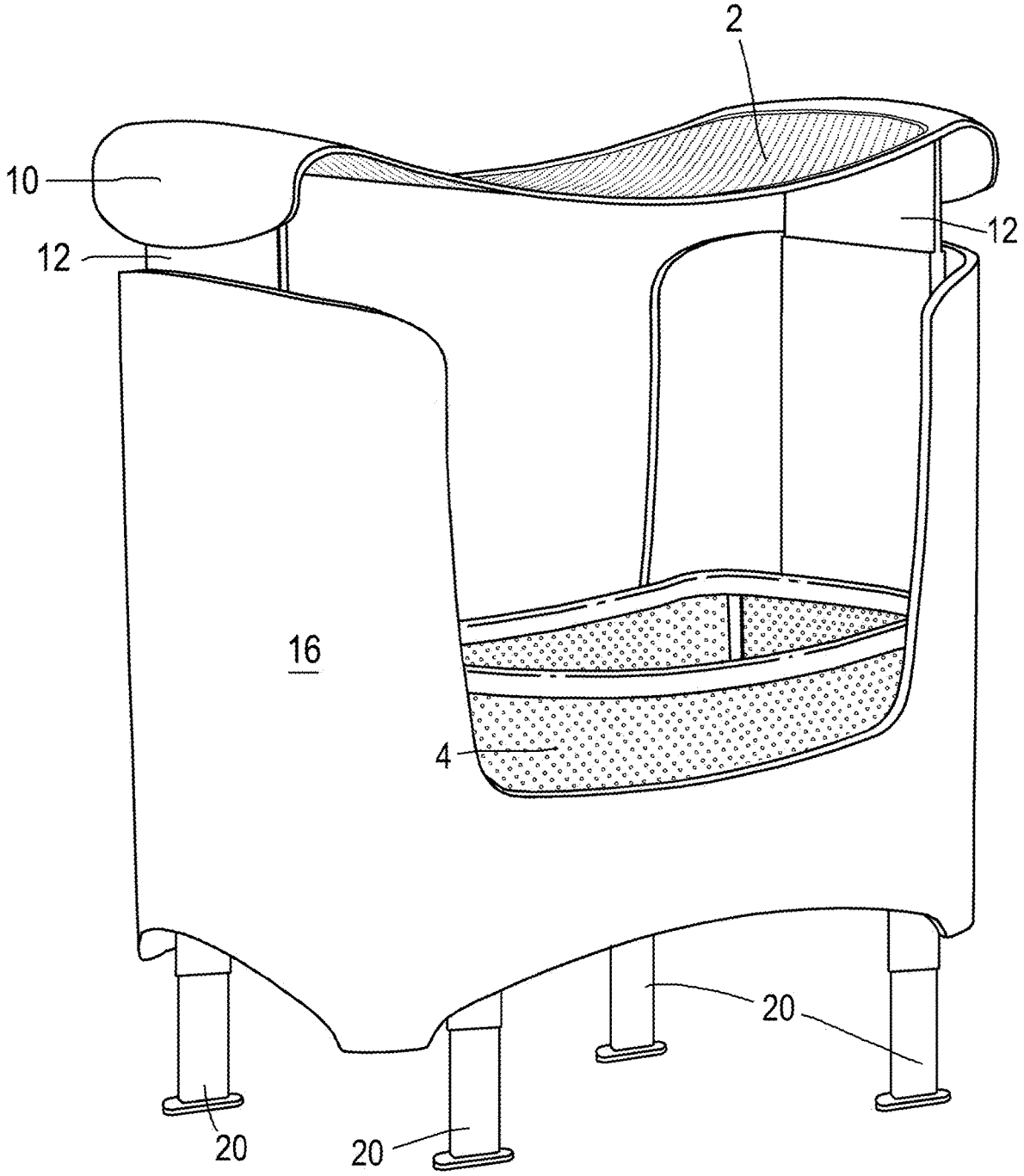
Figure 7:
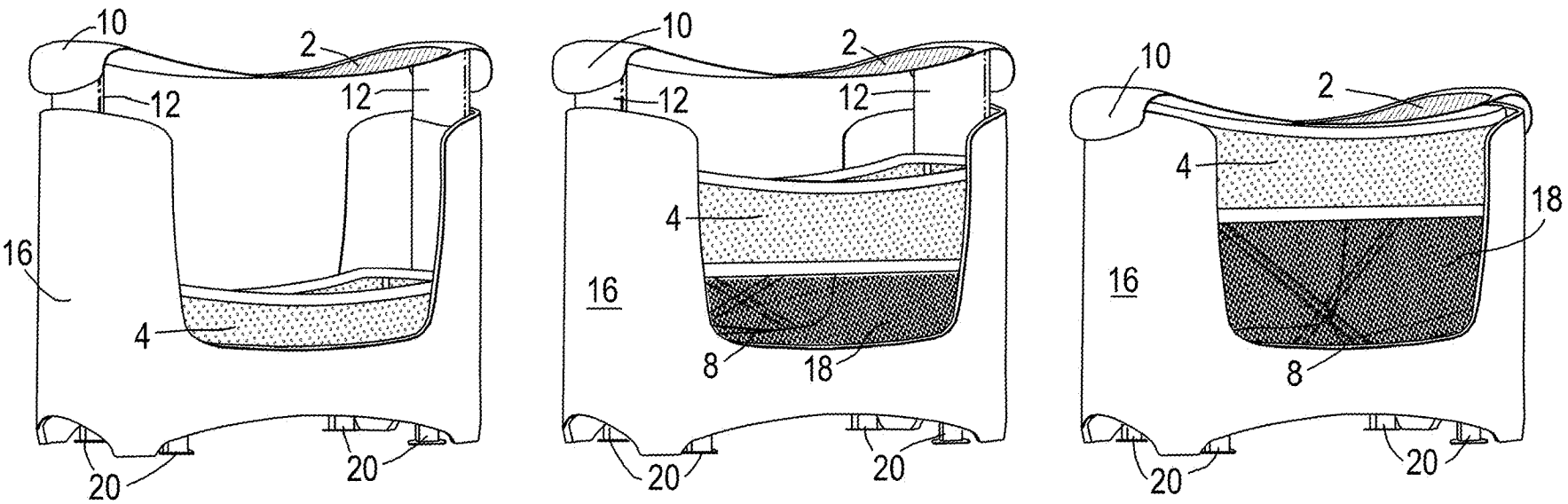

FIG. 2 depicts measurements of humidity, conducted in the same bedroom, over the same time period, with humidity sensors at the same height as the temperature sensors used to create the chart of FIG. 1. Once again, the lower sensor reading is given by the dashed line and the solid line provides the upper sensor reading. It is apparent from these readings that at higher elevations in the room, humidity is less consistent (the higher sensor records greater drops), and that higher elevations both experience drops in humidity before they are detected at lower inventions and don't exhibit increases in humidity until after lower elevations do.

It is evident from these tests that temperature, humidity, or both can depend on altitude even within the scale of a normal room in an ordinary house. It will be noted that the room in question was carpeted; it may be expected that the effect of altitude may be exacerbated in a room with, for example, a floor coated in linoleum or ceramic tiles. The intention of the present invention is to provide sleeping individuals with a more comfortable sleeping experience by providing a bed which can automatically adjust its height to reflect changes in temperature and humidity. In particular, this feature is considered useful in respect of baby cots, since infants are usually less able to otherwise make adjustments to account for such changes in their environment, but the additional comfort may also be of use to non-infants and beds for adults and older children incorporating the features of the invention are also envisioned.

FIGS. 3-7 depict a baby cot according to the present invention, exemplifying a range of preferable features. The cot depicted incorporates a cover 2, encircling wall 4, sleeping surface 6 surrounded by the encircling wall 4, and an automated elevation mechanism 8 arranged to raise the sleeping surface 6 and encircling wall 4. The illustrated automated elevation mechanism 8 is a scissor action mechanism, but any other elevation mechanism such as a telescopic linear actuator is also acceptable for use with the present invention provided that the elevation mechanism is controllable to raise or lower the sleeping surface 6 in response to temperature or humidity sensor data.

As an advantageous feature, the cover 2 is arranged on a frame 10 which has telescopic linear actuators 12, such that the cover can be lowered (either manually or automatically) to enclose the cot. This prevents infants from climbing out and falling to the floor when the cot is in an elevated position. Covers which raise or lower in this fashion do not constitute the only means by which such a cover could be implemented, of course; a cover provided as a separate item entirely, or a cover configured to slide over the opening described by the top of the enclosing wall 4, could also work. The sole requirement of a cover, where one is provided, is that it should be suitable for placing over the opening described by the encircling wall so as to prevent an infant from climbing out of the cot.

Preferably, the cover 2 and the encircling walls 4 comprise perforated fabric, with the cover 2 and encircling walls 4 being arranged on respective frames 10, 14. This allows airflow through the cot to prevent it from becoming stifling, as well as permitting light in.

Optionally, the cover 2 may also comprise features allowing the infant to be placed on top of the cover 2 in order for the infant's nappies to be changed.

In the depicted example of a baby cot according to the present invention, the automated elevation mechanism 8 is surrounded by a protective casing 16 and a spring loaded rolled fabric cover 18, which is attached to the encircling wall 4 and/or the encircling wall frame 14 and/or the protective casing 16, such that when the automated elevation mechanism 8 causes the cot to rise the spring loaded rolled fabric cover 18 is deployed in any gap between the encircling wall 4 or its frame 14 and the protective casing 16. This ensures that the mechanism is never directly accessible to infants, thereby improving safety. Where, as in the depicted cot, the cover 2 and/or its frame 10 is on telescoping linear actuators 12 or some other mechanism for elevating or lowering the cover, this mechanism can also be enclosed by protective casing 16 for similar safety reasons.

In the depicted example of a baby cot according to the present invention, the cot also includes the optional and preferable feature of having a set of telescoping linear actuator legs 20, which can be extended manually or automatically. Where these legs 20 can be extended automatically, they can provide additional elevation. Where they can be extended manually, they can be extended independently of the automated systems of the cot in order to provide additional elevation as required, or to compensate for an uneven floor.

Other elevation mechanisms can also be used. The elevation mechanisms could incorporate features comprised on or attached to the ground, or the floor, walls, or ceiling of the room that a bed according to the present invention is placed in. For example, the sleeping surface of the bed could be hung from the ceiling of the room via supports which can be extended or shortened, or by a rope and pulley system, permitting the sleeping surface to be raised or lowered. Alternatively or additionally, the elevation mechanism could make use of air—for instance, in a pneumatic system, or in inflatable components of the bed.

Elevation mechanisms according to the present invention are controlled automatically by the sensor signals and in this respect is a so-called "smart" system. In some beds according to the present invention, the elevation mechanism may additionally be controllable manually, either directly or via a remote control, or a smartphone app, or any other means by which a user can activate the elevation mechanism to lower or raise the sleeping surface to a level which the user desires.

Not depicted in the figures is the temperature and/or humidity sensors. Preferably, these are incorporated on the encircling wall frame 14, preferably at the four corners thereof, so that the temperature and/or humidity readings thus made can reflect the temperature or humidity at or close to the level of the sleeping surface 6.

The invention claimed is:

1. A bed comprising a sleeping surface and an elevation mechanism arranged to control the elevation of the sleeping surface, wherein the bed further comprises at least one temperature sensor configured to measure temperature in the environment surrounding the bed and/or at least one humidity sensor configured to measure humidity in the environment surrounding the bed, and the elevation mechanism is configured to automatically raise or lower the height of the entire sleeping surface to reflect changes in temperature and/or humidity, based on signals from the at least one temperature sensor and/or the at least one humidity sensor.

2. The bed of claim 1, wherein the environment surrounding the bed comprises a room in which the bed is placed.

3. The bed of claim 1, wherein the environment surrounding the bed comprises an area to the immediate exterior of the bed.

4. The bed of claim 1, wherein the at least one temperature sensor and/or at least one humidity sensor is configured to take measurements at the level of the sleeping surface.

5. The bed of claim 1, wherein the sleeping surface is inclined at an angle from the horizontal.

6. The bed of claim 1, further comprising user controls, wherein the user controls are configured to direct the elevation mechanism to elevate the entire sleeping surface to a specified height on receipt of a signal from the user controls.

7. The bed of claim 6, wherein the user controls comprise at least one of physical buttons provided on the bed, a remote control, or a smartphone app.

8. The bed of claim 1, wherein the bed is a baby cot.

9. The baby cot of claim 8, further comprising an encircling wall defining an opening.

10. The baby cot of claim 9, wherein the elevation mechanism is also arranged to control the elevation of the encircling wall.

11. The baby cot of claim 9, wherein the cot further comprises a cover that may be placed over the opening.

12. The baby cot of claim 8, further comprising a weight sensor arranged to detect when an infant is on the sleeping surface.

13. The baby cot of claim 12, wherein the elevation mechanism is configured to operate only when the weight sensor detects the infant on the sleeping surface.

14. A method of operating the bed according to claim 1, comprising the steps of:

a) receiving a signal from at least one temperature sensor and/or at least one humidity sensor;

b) sending to the elevation mechanism a signal to cause the elevation mechanism to adjust the height of the entire sleeping surface in response to the signal.

15. A control system for the bed according to claim 1, comprising a processor, wherein the processor is configured to receive a signal from the at least one temperature sensor and/or the at least one humidity sensor and send to the elevation mechanism a signal to cause the elevation mechanism to adjust the height of the entire sleeping surface in response to the signal.

16. A non-transitory computer-readable medium comprising program code which, when executed by a processor, will cause that processor to put into effect the method of claim 14.

* * * * *